US007003974B1

(12) United States Patent
Brooks

(10) Patent No.: US 7,003,974 B1
(45) Date of Patent: Feb. 28, 2006

(54) FLAKED ICE MAKER

(75) Inventor: Charles A. Brooks, North Little Rock, AR (US)

(73) Assignee: Chrystal L. Brooks, Irrevocable Trust, Tulsa, OK (US)

( * ) Notice: Subject to any disclaimer, the term of this patent is extended or adjusted under 35 U.S.C. 154(b) by 0 days.

(21) Appl. No.: 10/930,665

(22) Filed: Aug. 31, 2004

(51) Int. Cl.
*F25C 1/14* (2006.01)

(52) U.S. Cl. ..... 62/320; 62/354

(58) Field of Classification Search ..... 62/320, 62/354
See application file for complete search history.

(56) References Cited

U.S. PATENT DOCUMENTS 3,444,692 A * 5/1969 Huffman ..... 60/695
4,198,831 A * 4/1980 Barnard et al. ..... 62/320
4,429,551 A 2/1984 Hizume
4,467,622 A 8/1984 Takahashi et al.
4,741,173 A 5/1988 Neumann
4,969,337 A * 11/1990 Hida ..... 62/320
5,109,679 A 5/1992 Hida
5,197,300 A 3/1993 Sakamoto et al.
5,460,014 A 10/1995 Wang
5,911,749 A 6/1999 Sugie

* cited by examiner

*Primary Examiner*—William E. Tapolcai

(74) *Attorney, Agent, or Firm*—Head, Johnson & Kachigian

(57) ABSTRACT

An apparatus and method for transporting flaked ice upward. The device includes an upward transport tube with a shortened sleeve. A beveled lower end of the transport tube forms flaked ice of a desired size and transports it upward. The size of the flaked ice formed may be changed.

4 Claims, 3 Drawing Sheets

FLAKED ICE MAKER

BACKGROUND OF THE INVENTION

1. Field of the Invention.

The present invention relates to an improved flaked ice maker capable of depositing ice into bins that are substantially above the ice maker. Specifically, the present invention provides a flaked ice maker that pushes flaked ice upward through a tube without the need for an auger.

2. Prior Art.

There are many existing types of flaked ice making machines. Generally, when flaked ice is made by a screw-type machine, as it breaks into ice flakes, it falls to the side and downwardly from the machine. The extruding head breaks the ice into flakes in a radially outward direction. Often an ice sweep brushes the pieces of flaked ice to one side where they may fall down a chute or directly into a bin. Several different designs have been developed.

U.S. Pat. No. 4,429,551, issued on Feb. 7, 1984 to Hizume discloses an extrusion head for an auger type ice maker whose bosses extend downward over the topmost portion of the auger. The design is intended to prevent choking of crushed ice that is pushed up over the top of the extrusion head.

U.S. Pat. No. 4,467,622, issued on Aug. 28, 1984 to Takahashi et al. discloses an extrusion head specifically designed to form shaved ice of superior quality. The channels of the extrusion head formed by its bosses each contain a small slit or channel that allows air to escape from the ice. This prevents excessive cooling of the ice and forms harder shaved ice particles. This patent also contemplates the use of a standard method of breaking the ice bars into shaved ice chips.

U.S. Pat. No. 4,741,173, issued on May 3, 1988 to Neumann discloses an extrusion head having modified fins or bosses designed to prevent the ice column from rotating within the extrusion apparatus.

U.S. Pat. No. 5,109,679 issued on May 5, 1992 to Hida discloses an auger type ice making machine having multiple blades above the extrusion head for breaking the ice rods into shaved ice pieces. The blades are adjustable so that the size of the shaved ice pieces may be readily adjusted. The blades rotate at the same speed as the auger and the size of the ice pieces is adjusted by adjusting the distance between the blades.

U.S. Pat. No. 5,197,300 issued on Mar. 30, 1993 to Sakamoto et al. discloses an auger type ice making machine. The patent was developed by Hoshizaki. The device disclosed in this patent has an extrusion head that bobs, or oscillates, in an up and down motion. It is intended to convey some of the load applied to the extrusion head by the auger to a cam device located above the extrusion head.

U.S. Pat. No. 5,460,014 issued on Oct. 24, 1995 to Wang discloses an auger type ice making machine that has a unique auger-within-an-auger design. As with the other patents, this patent discloses the use of an annular flange to break apart the ice rods. The novelty of this patent lies in increasing the efficiency of heat transfer from the water to the FREON coolant.

U.S. Pat. No. 5,911,749 issued on Jun. 15, 1999 to Sugie discloses an auger-type ice maker. This patent is also owned by the Hoshizaki company. The patent discloses a specially designed boss for the formation of ice forming channels about the extrusion head. The lower end of the boss is curved in such a way as to prevent over compression of the ice. This reduces the back load on the auger, thereby increasing efficiency of the machine.

All of the designs in the prior art show machines that only extrude ice radially outward and the ice has been collected and pushed to one side and optionally downward. This has a number of disadvantages. The ice maker must be at the same height as or above the ice bin. This means that if an ice maker is low to the ground, so is the bin into which it dispenses ice. Persons retrieving ice from the bin must then bend over and this increases the difficulty of acquiring ice. In addition, ice at the bottom of the bin is rarely removed because ice is taken out of the bin from the top and therefore the freshest ice is the first removed. Ice bins that are elevated must have ice makers that are also elevated. It is common to place ice makers above ice bins. Because ice makers are very heavy, this poses a danger. In earthquake prone regions, such as California, laws require that heavy objects such as ice makers be firmly attached to a wall. Those skilled in the art will appreciate that it is both difficult and expensive to securely attach an ice maker to a wall.

Ice makers that are relatively far above the ground are also difficult to maintain and repair. Maintenance workers often must use a ladder to reach the ice maker. The danger is usually worsened by the fact that ice makers are typically in high volume traffic areas.

When ice machines are not properly maintained, they may freeze up. This may cause an ice machine to shake or shutter violently. If the ice machine is elevated, it may fall. This is an additional danger, especially in high volume traffic areas.

In addition, small amounts of chlorine gas evaporate out of crushed ice as it is present in the water typically used. When the ice machine is located above the bin, a chlorine gas may oxidize various components of the ice making machine.

Ice making machines require routine maintenance. This often involves cleaning the machine components with various chemicals. When the ice maker is located above an ice bin, these chemicals may leak into the ice bin.

It is therefore desirable to provide an ice maker that is located beneath an ice bin and may dispense ice upward without the need of an auger.

The only existing methods for moving flaked ice upward has been to use an auger. However, augers tend to compact ice and jam. Use of an auger also adds cost to the ice machine and increases the amount of maintenance required.

SUMMARY OF THE INVENTION

The present invention provides an ice maker having an extruder that is capable of depositing ice in a storage bin above it. The present invention also allows the size of the ice flakes to be adjusted to any desired size. The design prevents cleaning chemicals from leaking into the ice bin and prevents chlorine gas from entering the ice maker. It also allows for easier installation as the ice maker may be located on the ground. It avoids the need for earthquake proof equipment and eliminates the danger of having a heavy object several feet above the ground.

The improved flaked ice maker of the present invention has a sleeve and an ice transport tube located directly above the extrusion head. Just inside the sleeve is an adjustable, beveled surface which breaks the ice into pieces of a predetermined size. The flaked ice is pushed up the ice transport tube by new flaked ice entering into it below it. Because the ice is relatively loose, it does not compact and become jammed. The flaked ice typically forms a hollow cylinder that slides along the inside walls of the ice transport tube. Because the walls rapidly become coated with water, there is practically no friction and the ice readily ascends through the transport tube. As ice continues to enter the bottom of the transport tube, the hollow cylinder of ice continues to rise until it reaches the top of the transport tube. At this time, it falls into a storage bin. The device may be readily adapted to existing ice extruders. It may be used to replace more complex and less efficient devices such as propeller type devices used to produce flaked ice. The distance between the top of the extrusion head and the beveled region may be adjusted to change the size of the flaked ice.

The present invention allows an ice machine to be placed underneath an ice bin thereby making it safer, easier to maintain and easier for persons to retrieve ice from the ice bin.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The present invention comprises an ice transport tube for transporting flaked ice from an extrusion head to a bin above it. It is adjustable so that the size of the flaked ice pieces may be adjusted but has no moving parts. It may be fitted to any existing screw-type flaked ice machine. It may be used to deposit ice in a single bin or multiple bins.

Figure 1:
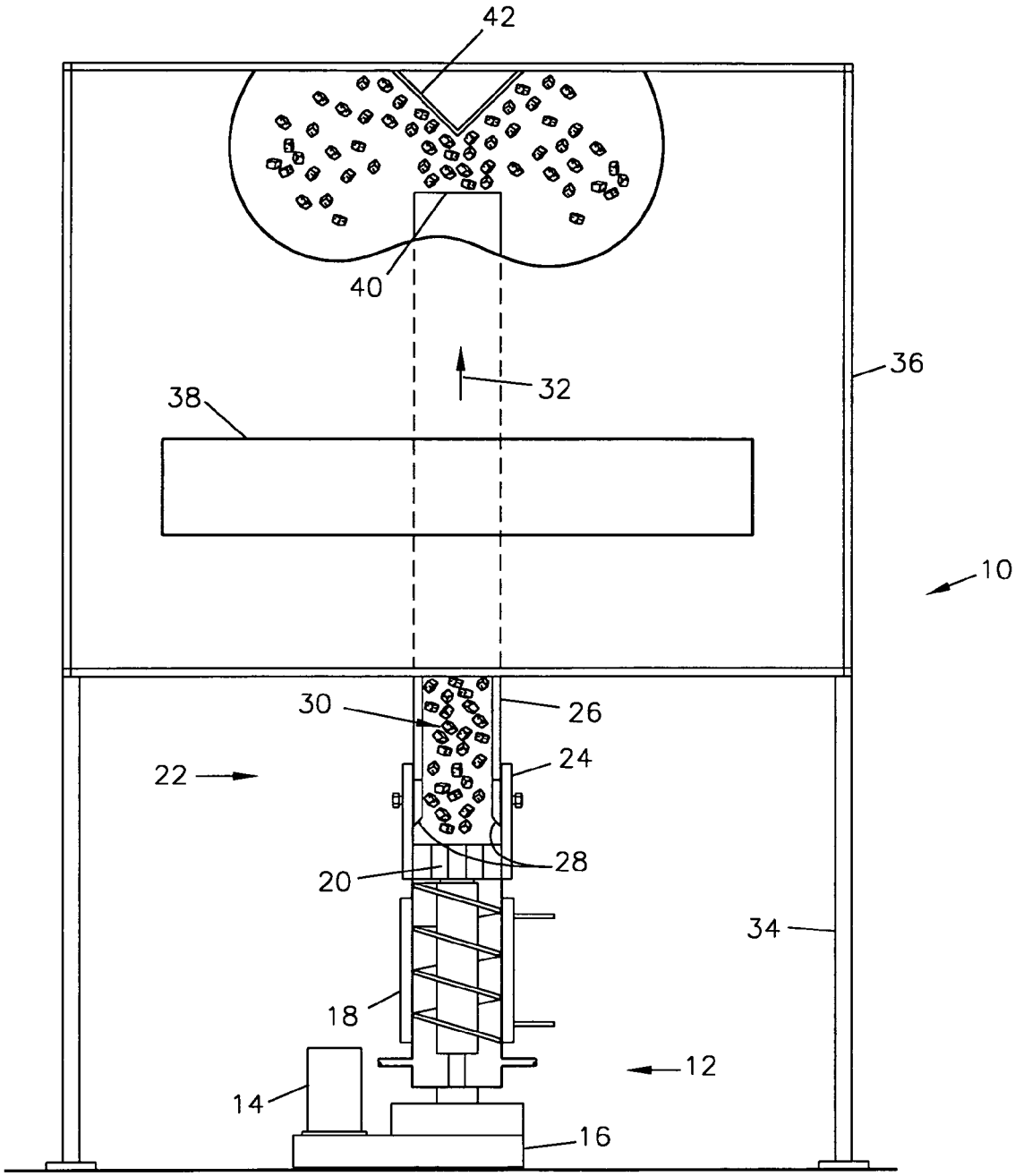
FIG. 1 shows a diagrammatic representation of a preferred embodiment of the invention.

FIG. 1 shows a preferred embodiment of the present invention. Ice maker 10 includes an ice bin 36 supported by ice bin stand 34. Within ice bin stand 34 is an improved flaked ice maker 22. Flaked ice maker 22 uses a standard screw-type mechanism 12 that is actuated by a motor 14 attached to gear box 16 to power the screw mechanism 18. Ice is pushed upward through extrusion head 20 and into sleeve 24. Sleeve 24 is adjustably attached to ice transport tube 26. An extrusion head 20 forms rods of ice. When these ice rods hit beveled end 28 of ice transport tube 26, they break into flaked ice pieces 30. As more ice enters transport tube 26, flaked ice pieces 30 are pushed upward in the direction of arrow 32 until they reach the top 40 of transport tube 26. Once they exit tube 26 through top 40, ice pieces 30 are deposited into ice bin 36 and may be accessed by ice bin door 38. Because the flaked ice may partially stick together, breaker 42 is provided in the top of ice bin 36 and is cone-shaped. Breaker 42 is optional and not necessary for the present invention but may ease the deposition of the flaked ice into the bin.

In the embodiment shown in FIG. 1, the flaked ice is deposited into a single bin directly above the ice maker. Those skilled in the art will appreciate that ice transport tube 26 may curve to either side and deposit ice in a bin that is not directly above it. Similarly, transport tube 26 may end in a T intersection and send ice to separate bins in opposite directions.

Figure 2:
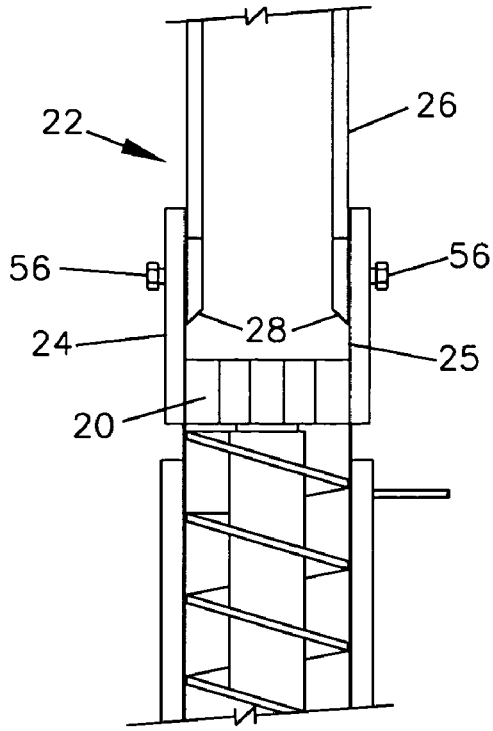
FIG. 2 shows an enlarged view of the invention as shown in FIG. 1.

FIG. 2 shows an enlarged view of the transport tube and sleeve of the present invention. Sleeve 24 attaches to extrusion head 20 such that rods of ice extruding from extrusion head 20 enters sleeve 24 on or about its inner wall 25. Transport tube 26 fits snugly within sleeve 24. Sleeve 24 has screws 56 that hold tube 26 in place. The use of a transport tube and a sleeve allows for the adjustment of the size of the flaked ice pieces. Screws 56 may be loosened and tube 26 is raised or lowered within sleeve 24. When beveled end 28 is the desired distance from extrusion head 20, screws 56 are tightened to firmly hold tube 26 in the desired position.

Both tube 26 and sleeve 24 are preferably made of inexpensive but safe material, such as polyvinylchloride (PVC). PVC tubes are easy to manipulate, lightweight and are non-contaminating. However, those skilled in the art will appreciate that there are a wide variety of other materials that may be used.

The sleeve may be designed such that it attaches to any extrusion head. Those skilled in the art will appreciate that different ice makers may have different nut and bolt or screw arrangements for attaching items to the top of extrusion heads. Those skilled in the art will appreciate that it is a relatively simple matter to manufacture a PVC tube capable of attaching to any flaked ice maker. It may be necessary to attach a flange to the sleeve so that it may be properly attached to an extrusion head.

The beveled end 28 of tube 26 is positioned so that it is directly above the portion of the extrusion head from which ice rods are extruded. Those skilled in the art will appreciate that angled surfaces have been used to break ice rods into flaked ice pieces. However, the prior art does not disclose angled surfaces positioned such that the flaked ice pieces fall inwardly toward each other. All of the prior art teaches that this is not practical and that the angled surface must be designed to break ice rods such that flaked ice pieces are sent radially outward. It had been thought that the design of the present invention was impractical and would not function properly. The design of the present invention, however, works very well and provides an efficient means of transporting flaked ice upward. Another surprising feature of this design is that it creates very little back pressure on the auger portion of the ice making machine.

Figure 3:
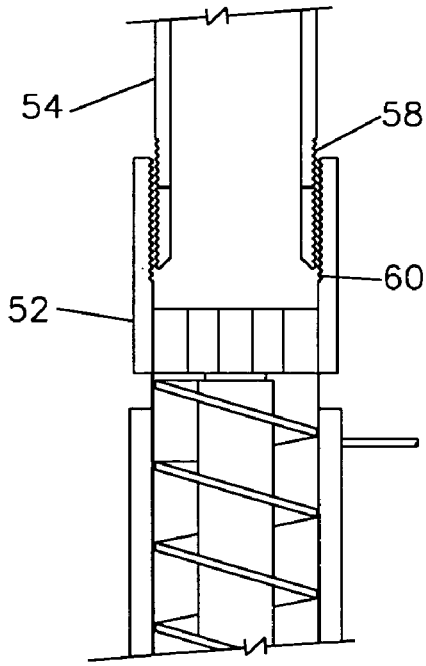
FIG. 3 shows an alternative embodiment of the invention.

FIG. 3 shows an alternative embodiment of the present invention. In this embodiment, transport tube 54 is threaded on its outer surface. Sleeve 52 has threading 58 on its outer surface. Sleeve 52 has threading 60 on its inner surface. Threadings 58 and 60 allow the transport tube 54 to screw into sleeve 52. The size of flaked ice pieces made may be adjusted by screwing sleeve 54 further into or out of sleeve 52. Those skilled in the art will appreciate that there are other means by which the distance between the beveled end of the transport tube in the top of the extrusion head may be adjusted.

Figure 4:
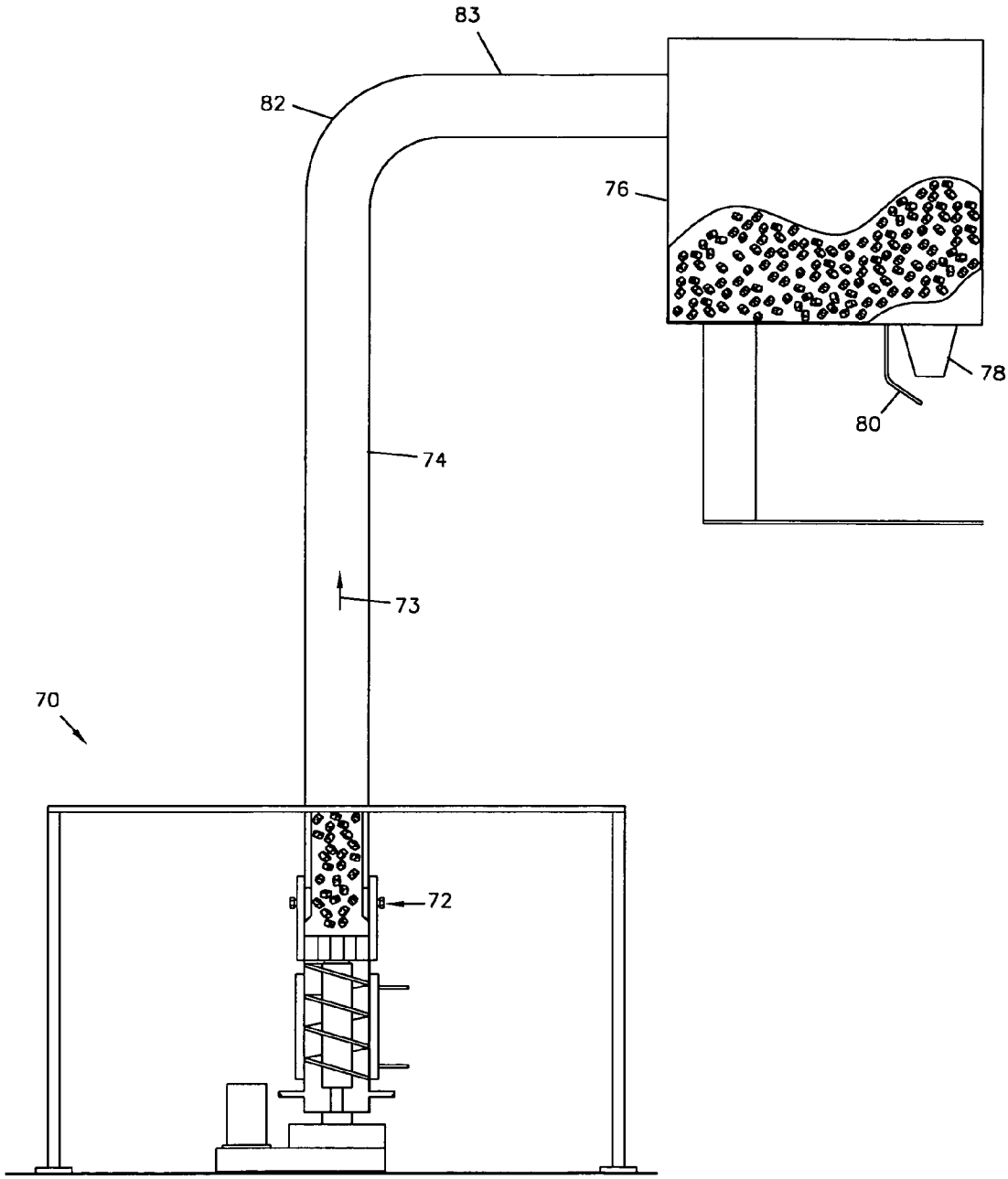
FIG. 4 shows an alternative embodiment of the invention.

One of the significant advantages of the present invention is the ability for the ice maker to be remotely located from the ice storage bin. FIG. 4 shows a flaked ice making machine 70 that feeds ice upward in the direction of arrow 73 through tube 74. The ice passes through elbow 82 into horizontal pipe 83. It is then dispensed into ice storage bin 76 where it may be dispensed through nozzle 78 when triggered by lever 80. This design allows the ice maker 70 to be placed a significant distance from bin 76. It also allows bin 76 to be placed at a substantially higher level than ice maker 70 which may be placed on the ground. Those skilled in the art will appreciate that this configuration avoids the disadvantages of the prior art described above.

Whereas, the present invention has been described in relation to the drawings attached hereto, it should be understood that other and further modifications, apart from those shown or suggested herein, may be made within the spirit and scope of this invention.

What is claimed is:

1. An improved flaked ice maker comprising:

a screw-type flaked ice machine having an extrusion head capable of forming rods of ice;

a sleeve attached to the extrusion head; and a transport tube having a beveled lower end and adjustably attached to the sleeve such that the distance between the beveled lower end and the extrusion head may be changed.

2. The apparatus of claim 1 wherein the sleeve and the transport tube are comprised of polyvinylchloride.

3. The device of claim 1 wherein the transport tube is adjustably attached to the sleeve by means of screws.

4. The device of claim 1 wherein the means of adjustably attaching the transport tube to the sleeve comprises threading.

* * * * *